United States Patent [19]

Lowe

[11] 4,230,247

[45] * Oct. 28, 1980

[54] COMBINATION FOLDABLE GOLF CLUB CARRIER AND SCORE KEEPING DEVICE

[76] Inventor: Gerald W. Lowe, 9330 Tropico Dr., La Mesa, Calif. 92041

[ * ] Notice: The portion of the term of this patent subsequent to Jul. 19, 1994, has been disclaimed.

[21] Appl. No.: 922,535

[22] Filed: Jul. 7, 1978

[51] Int. Cl.[3] ..... B65D 71/00

[52] U.S. Cl. ..... 224/45 R; 211/60 G

[58] Field of Search ..... 224/45 R, 45 S, 45 J; 211/60 G, 60 R, 67, 198; 248/97, 168; 116/120, 135

[56] References Cited

U.S. PATENT DOCUMENTS

| | | | |
|---|---|---|---|
| 3,071,339 | 1/1963 | Saint | 248/168 |
| 3,094,802 | 6/1963 | Penny | 248/168 |
| 4,036,416 | 7/1977 | Lowe | 224/45 R |

*Primary Examiner*—Robert J. Spar
*Assistant Examiner*—Kenneth Noland

[57] ABSTRACT

A practical golf club carrier weighing only 2 pounds or less, called by the inventor, the "Ee-Ze-Kar'i" Kad'i hereinafter to be referred to as the "Kad'i". Said Kad'i is comprised of three assemblies: a novel handle, utilized as a time-saving score keeping device; a longitudinal tray, channel or other form which supports pivoting, soft plastic, ball-holding split tubes, and which is attached at ends, directly to the bottom of vertex blocks and leg assemblies which pivot inward on a vertex block and fold into a closed parallel position.

2 Claims, 6 Drawing Figures

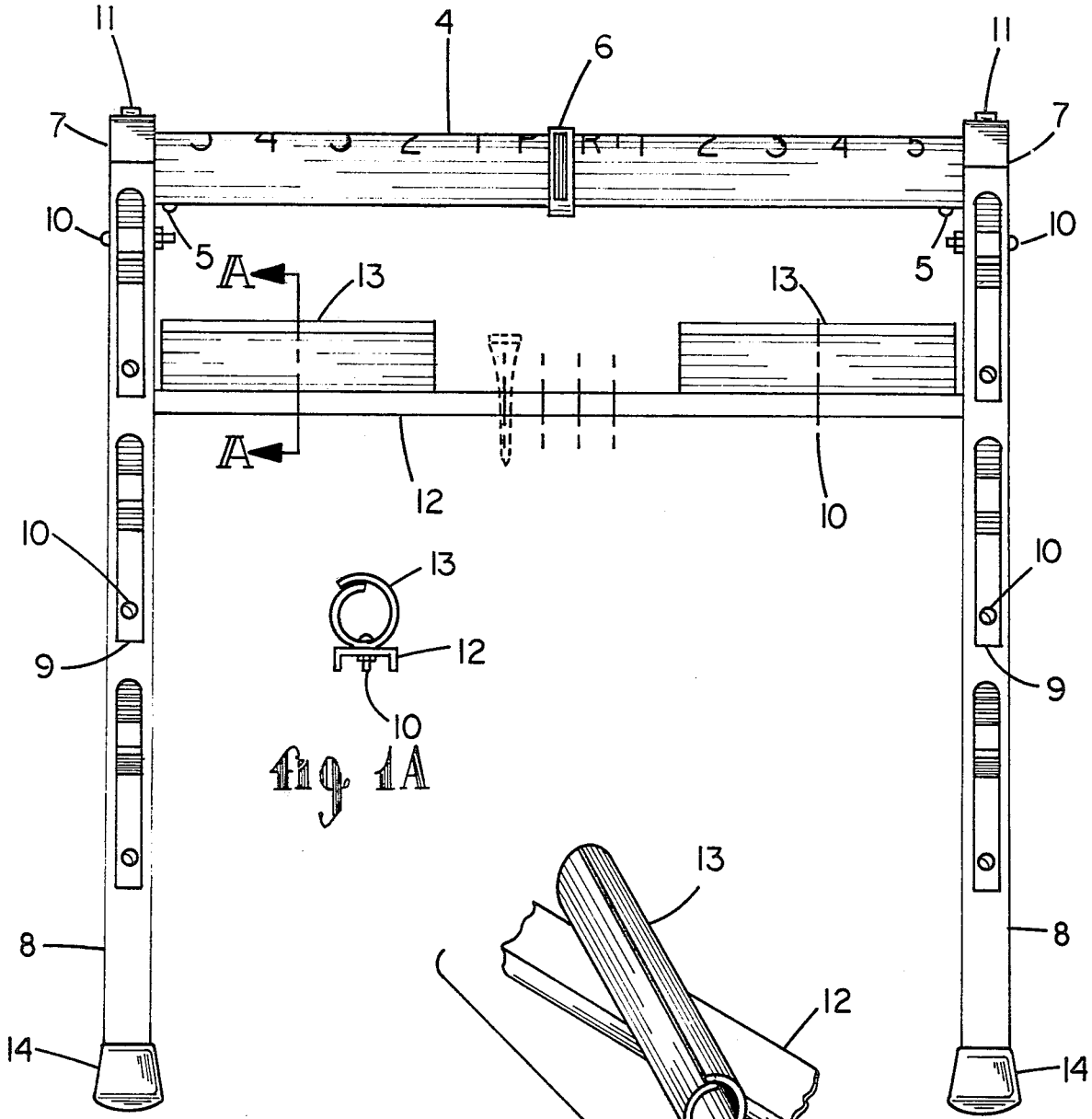
fig 1A
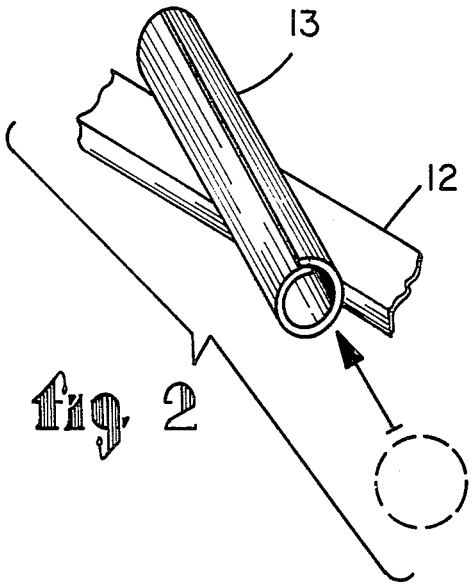
fig 2
fig 1

COMBINATION FOLDABLE GOLF CLUB CARRIER AND SCORE KEEPING DEVICE

The subject matter pertaining respectively to the Score Rule Assembly and the Leg Assemblies has been previously disclosed in U.S. Pat. No. 4,036,416 issued July 19, 1977 on 'Combination Foldable Golf Club Carrier and Score Keeping Device'.

An object of the invention is to provide a practical Kad'i which will offer the golfer a more leisurely game of golf because no more weight than is necessary is carried leisurely by the hand; time and steps are saved, thus the game of golf will become more relaxing and enjoyable.

Another object of the invention is to provide instant, over (or under) par, effortless, no paper or pencil, individual score keeping which is accomplished by just sliding a ring marker on the score rule which is utilized as the Kad'i handle; thus time is saved, conservation practiced and more leisure is gained for the golfer.

Another object of the invention is to provide an open carrier on which the clubs can be readily identified and 'by your side' where they can be conveniently snapped on and off the holding clips.

Another object of the invention is to provide an attractive, low cost carrier on which the clubs, themselves an object of beauty, can be brightly displayed and held by newly designed bright spring steel clips on a colorful A-frame, projecting an object of pride to the golfer, and a pleasant addition to the golf course.

An additional object of the invention is to provide instant identification and easy access to golf balls which are on display in two novel split plastic tubes, each tube being attached at its center to a tray by a fastener allowing said tubes to be rotated to facilitate the withdrawal and insertion of golf balls. Holes are drilled in the center area of the arrow tray to hold tees.

An additional object of the Kad'i invention is to provide a compact carrier which is easier to transport to and from the golf courses than the present heavy burdensome golf bags and carts being used so extensively. By use of the Kad'i these unnecessary inconveniences are ilimiated since the A-frame legs simply fold in; thus the Kad'i lies flat. Also the Kad'i, less clubs, weighing only about two pounds can be stowed in a suitcase for distant travel.

An original idea and feature of the Kad'i is the new and easy way of individual score keeping on the score rule which involves the movement of the ring marker; the operation and use thereof will be fully described, and examples given under numeral 6 of the specification.

To facilitate understanding of the ½ scale drawings on three sheets, the numerals representing detail parts of the Kad'i will be described and grouped according to their respective assemblies; there are three, and reference will be made to the drawing. Figures wherein like numerals denote like or corresponding parts throughout said drawings of which:

FIG. 1 is an elevational side view of the Kad'i invention, showing the embodiment of its three assemblies: the Score Rule assembly, the A-frame Leg assemblies, and the Tray with golf ball holding tubes. FIG. 6 shows Tube 13 centrally attached to Tray 12 by Fastener 10; four holes are drilled in the center area of said tray for holding golf ball tees.

FIG. 2 is a plan view perspective of the Tray and tube assembly showing Tube 13 rotated on centrally located Fastener 10 to an angular position of 25 to 45 degrees; this position facilitates the insertion and removal of golf balls.

A soft, plastic, split Tube 13 golf ball holder is shown in the normal contracted position, golf balls excluded. When a golf ball is placed at the end of said tube it expands and holds the ball as it is pushed further into the tube.

Figure 3:
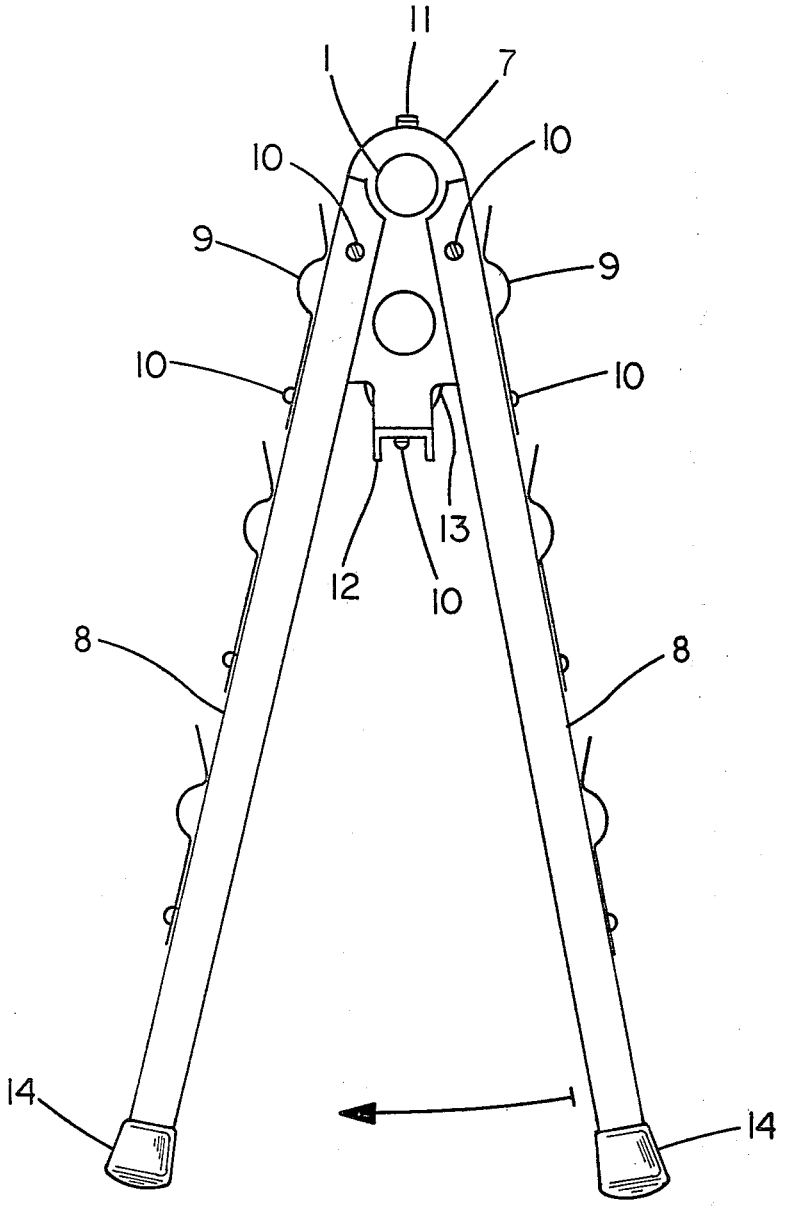

FIG. 3 is an elevational side view of the Kad'i exposing the A-frame configuration Legs 8 which can be folded to a closed parallel position by pivoting on Fasteners 10 in the Vertex block 7. Tray 12 is shown fastened to said vertex block by Fastener 10.

Golf club gripper Clips 9, the original design of the inventor, are shown attached equally spaced to Legs 8 by Fasteners 10.

Figure 4:
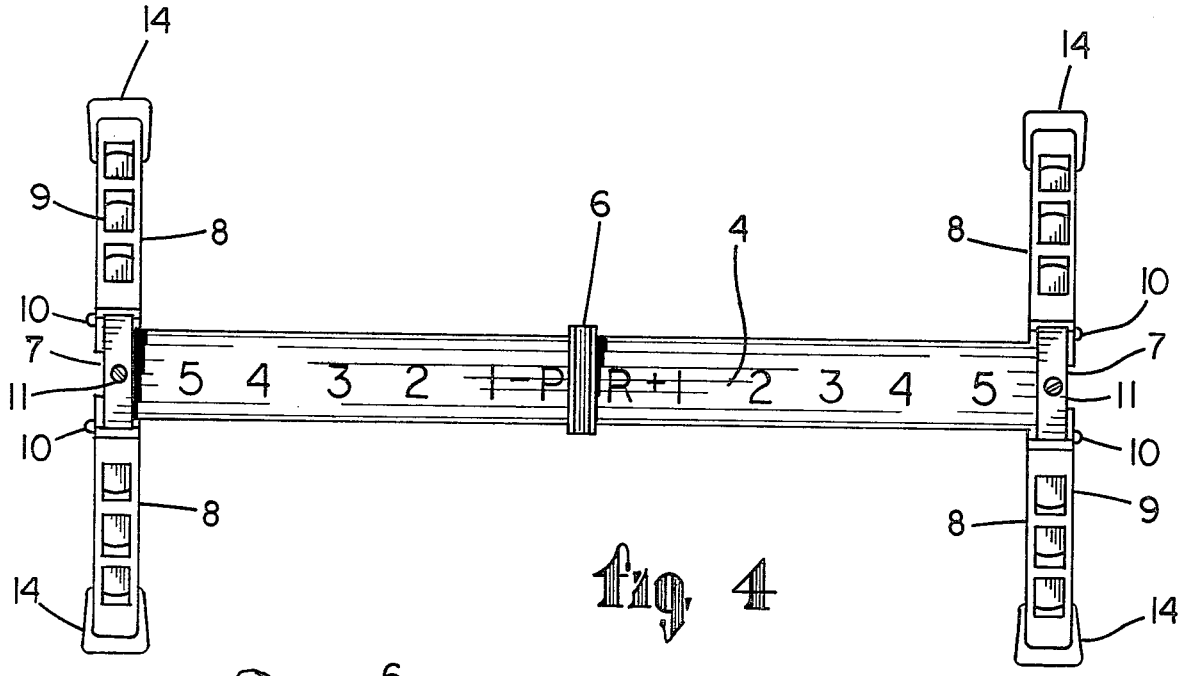

FIG. 4 is a plan view of the Kad'i. The score rule Marker 6 is shown centrally located (on PAR) where it must always be placed at the start of nine holes of golf.

A Leg assembly is attached to each end of the Score Rule assembly by means of the general assembly Fastener 11.

Figure 5:
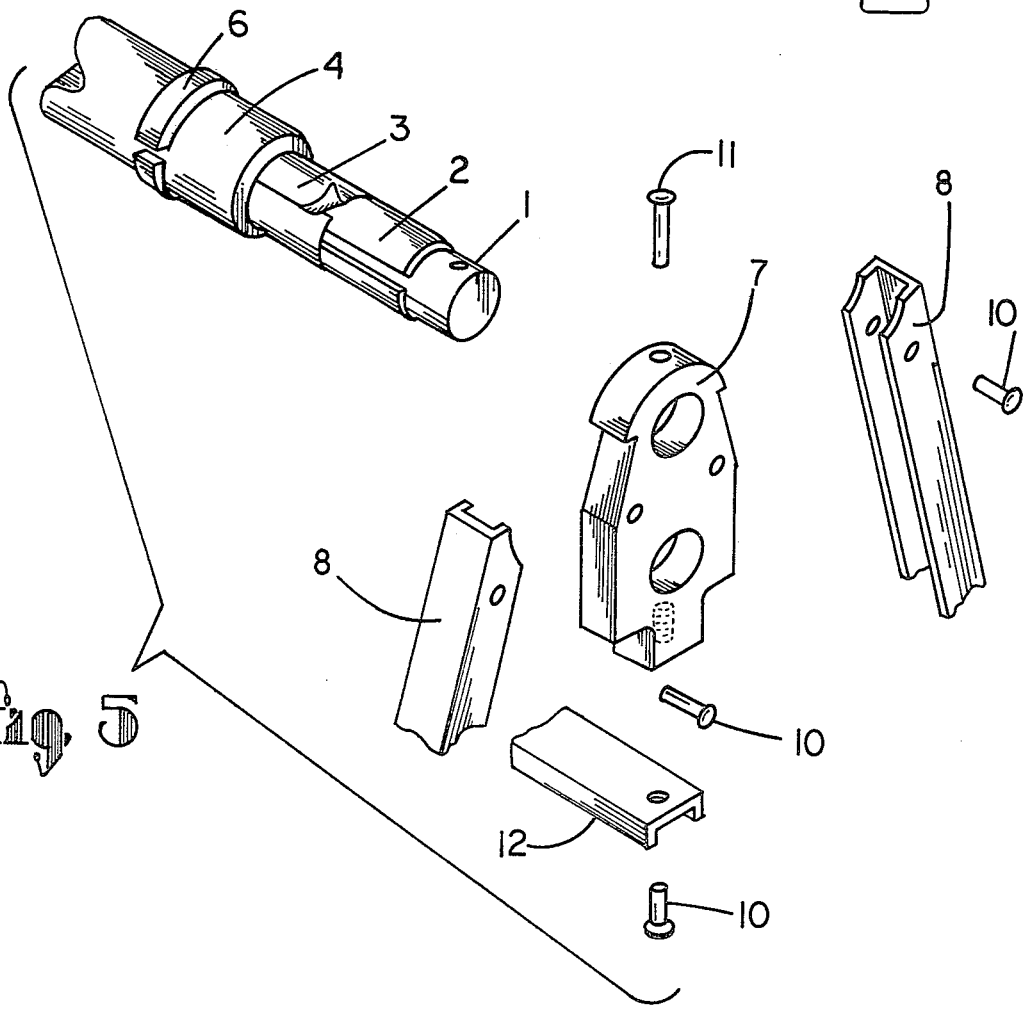

FIG. 5 is an expanded telescopic view of the Score Rule assembly, the true assembly view of which would show packing Strip 2, Score Strip 3, and acrylic Tube 4, identical in length. The lower portion of FIG. 5 is an exploded view of the Vertex block 7 and Legs 8; the true assembly view of which would show the inside surface of said channel Leg resting on the 13 degree angled surface of said vertex block. Fasteners 10 are then inserted into matching holes to provide the pivot point necessary in the Kad'i leg folding operation.

FIG. 6 is a sectional view of tray 12 and the attached split tube 13 which expands to hold golf balls.

On final assembly, the ends of Dowel 1 are inserted into Vertex block 7 at which time fasteners 11 are screwed into tapped vertically drilled holes in each said vertex block and through said dowel. Tray 12 is attached by Fasteners 10 through said tray and into tapped holes at the bottom center of each Vertex block 7.

Modification might be forthcoming to the present form of illustrated disclosure in order to conform to various methods of fastening, material employment, and fabrication thereof: in this respect the inventor asks allowance for such be granted without departing from the original tenor or practical intent of the Kad'i invention as herein set forth.

The following numerals indicate parts which comprise the Score Rule Handle assembly of the Kad'i invention:

1—(refer to FIGS. 3 & 5)

A Dowel, of wood or other suitable material approximately ¾ inches in diameter and 13 inches in length. Said dowel serves as the inner core of the score rule handle.

2—(refer to FIG. 5)

A strip of thin Packing; styrofoam or similar resilient material, is wrapped around dowel 1 for the purpose of filling the slight gap between said dowel, and inner wall of tube 4.

3—(refer to FIG. 5) and Score Strip inclosed.

The Score Strip is a piece of quality paper or other suitable material about two inches in width and 12 inches in length, upon which is printed, in bold type, a sequence of numbers centered and equally spaced about the word "−PAR+". The score strip is wrapped snuggly around dowel 1 and packing 2, and when this said trio is inserted into tube 4, the resiliatory action of said packing on said dowel presses the score strip smoothly against the inside wall of said tube.

4—(refer to FIGS. 1, 4, & 5)

A clear tube of acrylic, rigid plastic or other suitable material approximately $\frac{7}{8}$ inches inside diameter and 12 inches in length, incloses the dowel 1, packing 2, and score strip 3.

5—(refer to FIG. 1)

A small wood screw, pin, or suitable fastener at each end of tube 4 keeps said tube from turning on dowel 1. The fastener head must not interfere with the score marker 6 movement as it slides over said tube.

6—(refer to FIGS. 1, 4, & 5)

A split tube score Marker of non-cracking butyrate, or the like, about $\frac{1}{2}$ inch in length, and 1 inch inside diameter is used to slide over tube 4. The score marker may be wrapped on center with a narrow strip of thin contact tape, preferably rainbow, silver, or gold. Approximately $\frac{1}{2}$ inch of the tape ends are turned in and pressed against the inside surface of the score marker tube to beautify and to accentuate its location in respect to the numbers on the score strip 3. Other methods could be used for marking the golf score, including the use of a rubber O-ring or the like.

OPERATION AND USE OF THE SCORE RULE AND MARKER

The golfer selects a constant par at the start of each nine holes of play (high scorers, or beginners must use a high par). The objective is to make a few moves as possible with the ring marker. Some gold courses do not have the same par for each hole; a constant par is always used regardless. All that is necessary to know is the total par for the course with which to compare your nine hole score.

e.g. An average golfer picks 4 as a constant par for his game. He sets the marker on PAR in the center of the score rule handle. After each hole in which he shoots his par 4, the marker is not moved. But after each hole where he goes over (or under) 4, he moves the marker accordingly: e.g. if the golfer has 5 strokes on the next hole, he moves the marker one number to the right, to +1, which indicates 1 over par. If he then makes a hole in 2 strokes, he moves the marker back 2 places, to the left. The marker will then indicate that his score thus far is −1, or 1 under his par.

If during the course of the game his over (or under) par count happens to go over 5, the highest number on the score strip, he simply starts over again; in which case, 1 becomes 6, 2 becomes 7 etc. etc. This condition will seldom happen however when (through experience) the average Constant par is used.

At the end of each nine holes of play, the golfer knows his score immediately. It is 9 (holes)×(par) 4×36, plus (or minus) whatever the marker indicates. The golfer can then compare his score with the specified par of the course.

The following numerals indicate parts which comprise the Leg assemblies of the Kad'i:

7—(refer to FIGS. 1, 3, 4, & 5)

The Vertex Block is made of plexiglas or other, or suitable plastic compound in the event of the injection mold method of manufacturing is applied. By means of a fastener 10, channel legs 8 pivot on the block from a fixed open angle position of about 26 degrees to a closed parallel position. The radius ends of the block are stepped 1/16 of an inch, or the thickness of the said channel leg to allow a smooth outer surface at the joint of said leg and vertex block. The top hole, $\frac{3}{4}$ inches in diameter in the block is the receptacle for dowel 1. A self tapping machine screw Fastener 11 or the like, holds the tapped vertex block firmly to dowel 1. The lower $\frac{3}{4}$ inch hole in the block is merely an accessory hole. Corners of the bottom portion of the vertex block are notched out for clearance for assembly of clip 9 to leg 8 with fastener 10. A hole is tapped into the bottom surface of each block for the purpose of locating and securing tray 12 to the blocks with fasteners 10.

8—(refer to FIGS. 1, 3, 4, & 5)

Legs of the Kad'i are satin anadized aluminum $\frac{1}{2}$ inch channel pieces of various lengths, or other forms and material may be used instead, including those suitable for the injection mold process.

The preferred Leg length for a 4 club Kad'i is 11 inches; for a 6 club Kad'i, $13\frac{1}{2}$ inches; and for an 8 club Kad'i, $15\frac{3}{4}$ inches. The 4 or 6 club Kad'ies are appropriate for golfers who include an 'Adjustable' club in their sets.

9—(refer to FIGS. 1, 3, & 4)

The Clips, which grip the golf clubs and which are the original design of the inventor are made of $\frac{1}{2}$ inch wide bright spring steel, 0.025 inches in thickness. Other suitable materials may be used instead, including plastics in case of the injection mold process. The clips are equally spaced on each of the four legs 8. The number of clips used and the length of said legs may vary according to the manufacturer's choice of the number of golf clubs to be carried. The clips are secured to legs 8 by fasteners 10.

10—(refer to FIGS. 1, 3, 4, & 5)

Fasteners used are truss head machine screws, preferably No. 8×$\frac{1}{2}$ inches in length, accompanied with lock and flat washers, and nuts as required. They are used mainly for the attachment of clips 9, and are also used for attaching forthcoming Tray 12 to the bottom surface of vertex blocks 7, and for attaching split Tubes 13 to to said tray.

Other suitable fasteners, such as rivets, pins, or various type screws may be used on assembly and likewise identified as numeral 10 fasteners.

14—(refer to FIGS. 1, 3, & 4)

Soft plastic or rubber protective Tips which are pressed on to the bottom ends of the legs 8.

The following (numeral 11) is a common assembly item used to secure The score Rule assembly to the A-frame Leg assemblies:

11—(refer to FIGS. 1, 3, 4, & 5)

A self tapping machine Screw about $1\frac{1}{4}$ inches in length, or other suitable fastener, holds each of the vertically tapped vertex blocks of the Leg assemblies, firmly to the dowel 1 ends of the score Rule assembly.

The following numerals indicate parts which comprise the golf ball Tube and Tray assembly:

12—(refer to FIGS. 1, 2, 3, & 5)

A Tray, aluminum channel, or other form of structural brace, 13 inches in length for holding golf ball tubes, and tees.

13—(refer to FIGS. 1, 2, & 3)

Two pieces of soft plastic Tube, approximately four inches in length, preferably the standard $1\frac{1}{4}$ inch diameter thin wall type split along the top for the purpose of holding two golf balls each.

A limited number of tubular golf club carriers are currently seen on golf courses but they lack the combined advantage of foldability and the incorporation of a fast score keeping device.

The conventional method of playing golf involves the toting of heavy bags containing relatively light clubs, but since the shoulder strapped bag is usually too heavy to tote, a two-wheeled chariot contraption is employed to tote the big bag, and this combination is carted around the golf courses and often has to be parked or disobligingly detoured around sand traps, and rough or hilly ground causing a lot of zig-zag treading across the terrain, and also 'off the course' handling, stowing and transporting of this bulky equipment in current economically compact cars, creates a chronic chore frequently requiring the magical maneuvering of a golfin' Houdini.

While the Kad'i herein disclosed, illustrated, and described is at times confined to certain structural details, I do not wish to limit myself to such details but desire to cover other forms and materials which come within the scope of my invention and the following claims.

I claim:

1. A device designed to relieve the golfer of inconveniences caused by unnecessarily heavy and bulky conventional golfing equipment; said device, which is easy to carry around golf courses and convenient to handle when transporting to and from the golf course, having structure consisting primarily of two identical A-frame assemblies containing a vertex block at each end with a hole to receive and secure by fasteners an extended dowel end of a handle, each of said vertex blocks having tapered sides, the tapered sides of said vertex blocks slip into aluminum legs and each vertex block held accurately by one fastener on which each of said legs can be pivoted from a 13 degree open angle, to an inward 0 degree closed position where said legs would lie parallel to each other, each of said legs secured theron approximately four thin spring steel gripper clips which are equally spaced vertically and aligned so that a horizontal positioning of golf clubs can be easily achieved and also so that said golf clubs may be securely held within said clips; the device further including a narrow tray which is connected to the bottom surfaces of said vertex blocks and serving as a short-legged structural channel stiffener for the device, two pieces of soft plastic tubing, each of proper length to hold two golf balls and being secured to said tray, with each said pieces of tubing being split in a straight line along the top, the sides of each of the splits being overlapped, thus resulting in a slight diameter reduction and causing a contracting action in order to retain golf balls when inserted therin; each of said split pieces of tubing normally extending longitudinally along said tray and being secured to said tray by centrally located fasteners which permit the pieces of tubing to be rotated to facilitate golf ball insertion and removal without interference with the said handle or the golf clubs.

2. The device of claim 1 wherin said handle further includes a scorekeeping device which indicates only the number of strokes over (or under) a chosen constant par in a golf game, renders the use of score card and pencils unnecessary, and provides a fast and easy method of scorekeeping; said scorekeeping device being part of the golf club carrier and including a dowel wrapped with a score strip which portrays a sequence of numerals enclosed in a clear acrylic tube, said clear acrylic tube being mounted with a slidable ring for the purpose of facilitating scorekeeping by instant indication of the number of an individual golfer's strokes over (or under) his chosen constant par in a golf game.

* * * * *